US005280737A

United States Patent [19]

Floyd

[11] Patent Number: 5,280,737

[45] Date of Patent: Jan. 25, 1994

[54] HAMMER

[76] Inventor: Ted Floyd, 453 Grand Ave., Spring Valley, Calif. 91977

[21] Appl. No.: 2,643

[22] Filed: Jan. 11, 1993

[51] Int. Cl.[5] ..... B25D 1/00

[52] U.S. Cl. ..... 81/20; 81/23; 254/26 R

[58] Field of Search ..... 81/20, 23, 24; 403/250, 403/251, 277, 409.1; 254/26 R

[56] References Cited

U.S. PATENT DOCUMENTS

| | | | |
|---|---|---|---|
| 2,597,876 | 5/1952 | Kurkjian | 81/23 |
| 4,465,115 | 8/1984 | Palomera | 81/24 |
| 5,213,023 | 5/1993 | Floyd | 81/20 |

*Primary Examiner*—James G. Smith
*Attorney, Agent, or Firm*—Charles C. Logan, II

[57] ABSTRACT

A hammer having unique structure in the handle receiving central portion of its hammer head unit. A wedge unit is formed from two intersecting wedge sections that are made of a specific plastic material. The top surface of one of the wedge sections is spaced downwardly a predetermined distance from the top surface of the other wedge section to form a channel for receiving a magnet. The wedge unit is driven into the top end of the hammer causing the wood to be wedged outwardly in four directions within the handle receiving central portion of the hammer head unit. The wedge sections of the wedge unit have a plurality of horizontal barbs and the respective slots formed in the top end of the handle have mating notches for receiving the horizontal barbs of the wedge unit. An epoxy adhesive may also be used to aid in holding the wedge unit in the top end of the handle.

6 Claims, 1 Drawing Sheet

HAMMER

BACKGROUND OF THE INVENTION

The invention relates to a hammer and more specifically to one having novel structure for its hammer head unit and the wedge unit that is driven into the top end of the handle.

Prior art hammers generally have a hammer head unit having a handle receiving central portion that only tapers along two of the inside walls of the opening that receives the top end of the handle. The opening at its bottom end is smaller than at its top end. In order to secure the top end of the handle to the hammer head unit, a linear extending wedge is driven down into the top of the handle spreading it out into two directions against the two tapered inside wall surfaces of the opening. Sometimes the linear extending wedge does not hold the top of the handle firmly enough in the hammer head unit and it works loose which is annoying and dangerous during use.

Existing hammers also have no convenient structure that would allow a nail to be held by the top end of the hammer head unit while starting to hammer the nail in a direction perpendicular to the direction the hammer is normally struck.

It is an object of the invention to provide a novel wedge unit that provides a more positive structure for securing the top end of the handle to the hammer head unit.

It is also an object of the invention to provide a novel hammer that has structure both in the top end of the handle receiving central portion of the hammer head unit and also in the wedge unit that allows a nail to be magnetically held in position during hammer strokes made perpendicular to the normal direction in which the hammer unit is swung.

SUMMARY OF THE INVENTION

The novel hammer has a hammer bead unit having a handle receiving central portion. A 4-sided bore hole extends from the top edge of the handle receiving central portion to its bottom edge. The 4-sided bore hole is in alignment with the vertical axis of the handle receiving central portion. The 4-sided bore hole is formed by a front inside wall, a rear inside wall, and left and right inside walls. All four of these inside walls taper outwardly at a predetermined angle from their bottom edges to their top edges.

The wedge unit has been designed to interrelate with the 4-sided bore hole of the handle receiving central portion of the hammer bead unit. The wedge unit is formed by an x-axis wedge section that intersects the z-axis wedge section at 90 degrees. The length of these two wedge sections is less than the dimensions of the length and width of the 4-sided bore hole. The wedge unit is driven down into the top end of the handle after the top end of the handle has been inserted upwardly through the 4-sided bore hole. Due to the wedge unit having 4 fingers that are perpendicular to each other, when the wedge unit is driven into the top end of the handle it spreads the wood into four directions at 90 degree angles to each other. This wedges the top end of the handle tightly within the interior of the 4-sided bore hole and grips it in place. There are a plurality of horizontal barbs on each of the wedge sections that increase the gripping power of the wedge unit into the wood of the handle. The top end of the handle also has an x-axis slot and a z-axis slot that intersect each other and these respective slots have mating notches for receiving the horizontal barbs of said wedge unit.

The wedge unit is preferably made of a plastic material such as glass nylon. The magnet that is secured to the wedge unit would preferably be made of ALNICO or ALCOMAX material and an epoxy adhesive may be used to aid in securing the wedge unit into the top end of the wood handle.

The top surface of the z-axis wedge section is positioned a predetermined height below the top surface of the x-axis wedge section thereby forming a laterally extending groove in the top surface of the x-axis wedge section. A transversely extending channel is also formed in the x-axis wedge section for receiving an elongated magnet that is captured by a pair of lip members that extend inwardly toward each other adjacent the top edge of said channel. A shoulder extends upwardly from the top surface of the z-axis wedge section adjacent its front end to limit the distance that the magnet can be slid front end first into the channel formed in the top portion of said x-axis wedge section.

The magnet allows a nail to be laid on the top surface of the z-axis wedge section along its entire length and be captured by the magnetic properties of the magnet. The wedge unit is pounded into the top end of the handle until the wedge unit and the top of the handle are flush with the top edge of the handle receiving central portion. It is therefore necessary that a groove be formed along the top edge of the side wall of the handle receiving central portion. This allows a nail captured on the top surface of the magnet to have its bottom end pass through the groove while the head of the nail would abut the other side wall of the handle receiving portion. This feature of the hammer is used when it is desirable to start a nail in a location which does not allow the head of the hammer to be used. The head is turned perpendicular to its normal direction of usage and the nail can be started by short lateral motions of the hammer unit in the direction of the axis of the nail which is captured in its top surface.

DESCRIPTION OF THE PREFERRED EMBODIMENT

Figure 1:
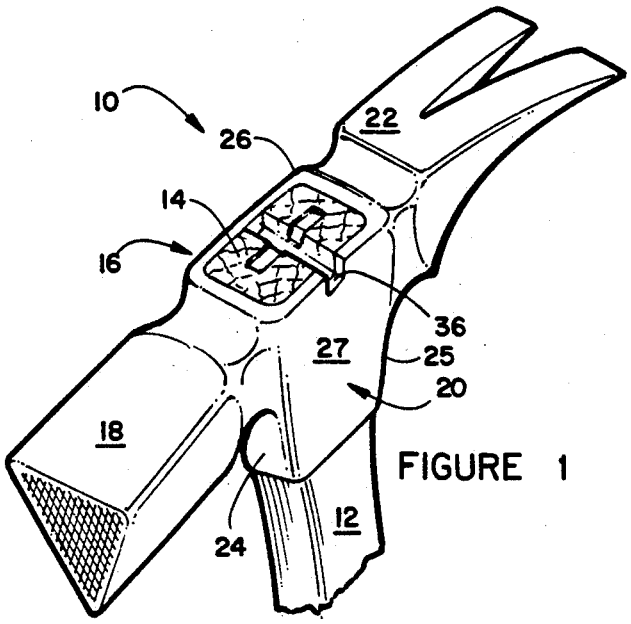
FIG. 1 is a partial front perspective view of the novel hammer.
Figure 2:
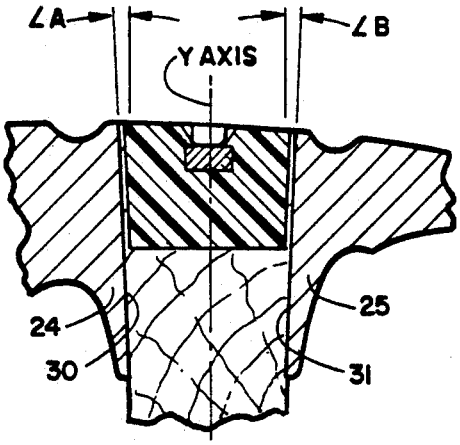
FIG. 2 is a partial cross sectional view illustrating the top end of the handle inserted into the 4-sided bore hole of the hammer head.
Figure 3:
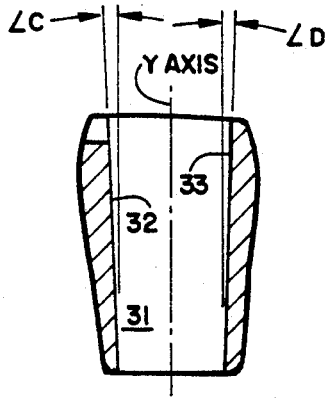
FIG. 3 is a cross sectional view taken perpendicular to FIG. 2 and showing the inside wall surfaces of the 4-sided bore hole.
Figure 4:
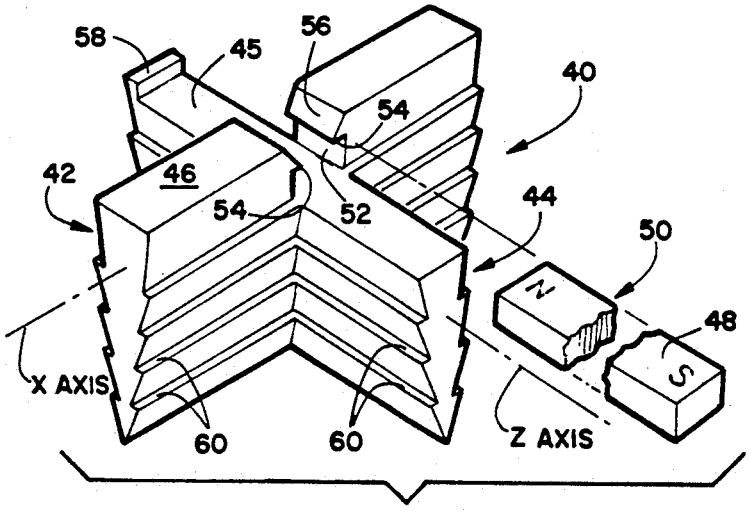
FIG. 4 is an enlarged front perspective view of the wedge unit.

The novel hammer and its wedge unit will now be described by referring to FIGS. 1–6 of the drawing. The hammer is generally designated numeral 10.

Hammer 10 has a handle 12 having a top end 14.

Hammer head unit 16 has a hammer portion 18 a handle receiving central portion 20 and a claw portion 22.

Handle receiving central portion 20 has a front wall 24, a rear wall 25, a left side wall 26 and a right side wall 27.

Handle receiving central portion 20 has a 4-sided bore hole that extends longitudinally along the y-axis. The 4-sided bore hole is formed by a front inside wall 30, a rear inside wall 31, a left inside wall 32 and a right inside wall 33. Front inside wall 30 tapers upwardly and outwardly at an angle A. Rear inside wall 33 tapers upwardly and outwardly at an angle B. Left inside wall 32 tapers upwardly and outwardly at an angle C and right inside wall 33 tapers upwardly and outwardly at an angle D. Angles A,B,C and D range between 1 and 5 degrees. The top edge of side wall 27 has a groove 36 formed therein to provide an opening through which passes the shank of a nail.

Wedge unit 40 is formed from an x-axis wedge section 42 and a z-axis wedge section 44. The top surface 45 of z-axis wedge section 44 is spaced a predetermined distance below the top surface 46 of x-axis wedge section 42. This forms a groove in the top surface 46 and thus allows a nail to have its shank lie entirely on the top surface of magnet 50.

X-axis wedge section 42 also has a channel 52 that lockably receives magnet 50 as it is slidably inserted front end first into channel 52. Lip members 54 mate with top surface 46. The top surface of these lip members is formed by beveled top surfaces 56. A shoulder 58 extends upwardly from the front end of top surface 45 to limit the distance that magnet 50 can be slid through channel 52.

The groove in the top surface of x-axis wedge section 42 thus allows a nail to have its shank portion to lie entirely on the top surface 48 of magnet 50 with its bottom end extending through groove 36. The nail would be held in place by the magnets magnetic properties. A plurality of horizontal barbs 60 are vertically spaced upon the outer surfaces of the respective wedge sections 42 and 44. Z-axis wedge section 44 would have a predetermined length that would be less than the width of the 4-sided bore hole. X-axis wedge section 42 would have a length that would be less than length of the 4-sided bore hole. This is critical since it is necessary that the wedge unit be spaced a predetermined distance from the metal of the handle receiving central portion 20.

Figure 5:
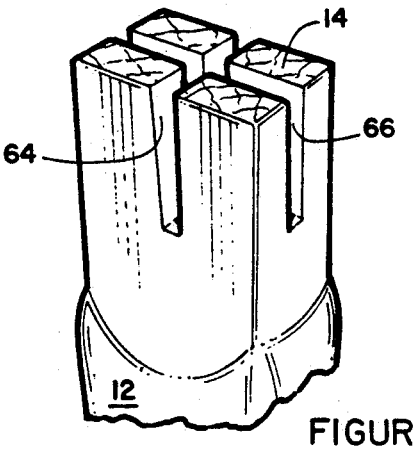
FIG. 5 is a partial front perspective view of the top end of a hammer handle before wedge-shaped notches have been formed therein.
Figure 6:
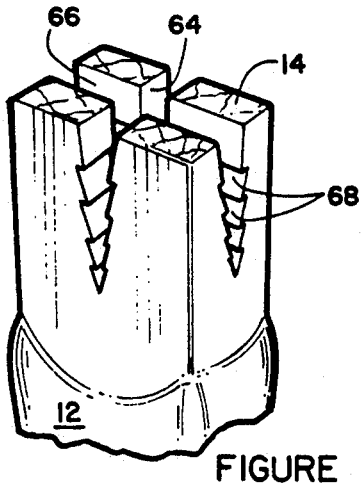
FIG. 6 is a partial front perspective view of the top of the handle after the wedge-shaped notches have been formed therein.

The top end 14 of handle 12 is illustrated in FIGS. 5 and 6. It initially has an x-axis slot 64 and a z-axis 66. Notches 68 are later formed in the respective slots to matingly receive the horizontal barbs 60 of wedge unit 40. An epoxy adhesive would normally be spread into the respective x and z-axis slots 64 and 66 prior to wedge unit 40 being driven therein.

What is claimed is:

1. A hammer comprising:

a handle having a top end;

a hammer head unit having a hammer portion, a handle receiving central portion and a claw portion;

said handle receiving central portion having a top edge, a bottom edge, a vertical y-axis and a 4-sided bore hole that extends along said y-axis from said bottom edge to said top edge;

said 4-sided bore hole having a front inside wall, a rear inside wall, and left and right inside walls, the respective inside walls taper outwardly from their bottom edge to their top edge so that the top end of said 4-sided bore hole is greater in size than its bottom end;

a wedge unit formed from an x-axis wedge section and a z-axis wedge section that intersect each other at a predetermined angle, the respective wedge sections have predetermined lengths, said x-axis wedge section having a top surface and a bottom surface, said z-axis wedge section intersects said x-axis wedge section along a vertical y-axis, said z-axis wedge section having a top surface and its top surface being spaced downwardly a predetermined distance from the top surface of said x-axis wedge section to from a channel for receiving a magnet;

an elongated magnet having a front end, a rear end, a top surface and a bottom surface;

means for locking said magnet in said channel formed in the top wall of said x-axis wedge section comprising a pair of lip members that extend inwardly toward each other adjacent the top edge of said channel; and said wedge unit being received in the top end of said handle within the perimeter formed by the top end of said 4-sided bore hole.

2. A hammer as recited in claim 1 further comprising means for limiting the distance that said magnet can be slid front end first into the channel formed in the top portion of said x-axis wedge section comprising a shoulder extending upwardly from the top surface of said z-axis wedge section adjacent its front end.

3. A hammer as recited in claim 1 wherein said wedge sections of said wedge unit have a plurality of horizontal barbs that function to lock said wedge unit into the top end of the handle of a hammer.

4. A hammer as recited in claim 1 wherein the top edge of one of the side walls of said handle receiving central portion has a groove for removably receiving the shank portion of a nail.

5. A hammer as recited in claim 3 wherein the top end of said handle has an x-axis slot and a z-axis slot that intersect each other and said respective slots having mating notches for receiving the horizontal barbs of said wedge unit.

6. A wedge unit comprising an x-axis wedge section and a z-axis wedge section that intersect each other at a predetermined angle, the respective wedge sections have predetermined lengths, said x-axis wedge section having a top surface and a bottom surface, said z-axis wedge section intersects the x-axis wedge section along a vertical y-axis, said z-axis wedge section having a top surface and a bottom surface and its top surface being spaced downwardly a predetermined distance from the top surface of said x-axis wedge section to form a channel for receiving a magnet;

an elongated magnet having a front end, a rear end, a top surface and a bottom surface; and means for locking said magnet in the channel formed in the top wall of said x-axis wedge section comprising a pair of lip members that extend inwardly toward each other adjacent the top end of said channel.

* * * * *